US007542698B2

(12) United States Patent
Burchette et al.

(10) Patent No.: US 7,542,698 B2
(45) Date of Patent: Jun. 2, 2009

(54) SYSTEMS AND METHODS FOR MANUFACTURING IMAGING COMPONENTS

(75) Inventors: Lynton R. Burchette, Sanford, NC (US); Stephen R. Lund, Cary, NC (US)

(73) Assignee: Static Control Components, Inc., Sanford, NC (US)

( * ) Notice: Subject to any disclaimer, the term of this patent is extended or adjusted under 35 U.S.C. 154(b) by 207 days.

(21) Appl. No.: 11/445,641

(22) Filed: Jun. 2, 2006

(65) Prior Publication Data

US 2006/0275050 A1 Dec. 7, 2006

Related U.S. Application Data

(63) Continuation-in-part of application No. 11/145,488, filed on Jun. 3, 2005, now Pat. No. 7,212,765.

(51) Int. Cl.
*G03G 15/00* (2006.01)

(52) U.S. Cl. ..... 399/109

(58) Field of Classification Search ..... 399/109
See application file for complete search history.

(56) References Cited

U.S. PATENT DOCUMENTS

| | | | | |
|---|---|---|---|---|
| 5,754,926 | A | 5/1998 | Sakuraba | |
| 5,835,817 | A | 11/1998 | Bullock | |
| 6,404,995 | B1 | 6/2002 | Kimizuka | |
| 6,505,013 | B1 | 1/2003 | Bedford | |
| 2004/0067074 | A1 * | 4/2004 | Yamazaki | 399/176 |

FOREIGN PATENT DOCUMENTS

| | | |
|---|---|---|
| EP | 0913737 A2 | 5/1999 |
| EP | 0913737 A3 | 7/1999 |
| JP | 2002221876 | 8/2002 |

* cited by examiner

*Primary Examiner*—Ryan Gleitz

(57) ABSTRACT

Systems and methods of remanufacturing an imaging cartridge include providing the imaging cartridge adapted to receive a signal from an imaging device and apply the signal to a component of the imaging cartridge, and attaching a signal modification element to the imaging cartridge to form a modified imaging cartridge, the signal modification element adapted to receive the signal from the imaging device, modify the signal to form a modified signal, and apply the modified signal to the component of the modified imaging cartridge.

2 Claims, 4 Drawing Sheets

SYSTEMS AND METHODS FOR MANUFACTURING IMAGING COMPONENTS

The present application is a continuation-in-part of U.S. patent application Ser. No. 11/145,488 filed on Jun. 3, 2005 which is incorporated by reference herein in its entirety.

BACKGROUND

The present invention generally relates to manufacturing, remanufacturing or repairing replaceable imaging components, such as a laser printer toner cartridge, and more particularly to apparatus and techniques for modifying a signal provided to the replaceable imaging component.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Due to the characteristics of particular types of replacement toner or cartridge components used in the remanufacturing process, certain problems may develop during printing using a toner cartridge containing the replacement toner. These problems may be caused by excess residual toner particles clinging to a component, such as the primary charge roller (PCR), of the toner cartridge, resulting in the excess toner being transferred to the paper in the form of print defects. Thus, there is a need for techniques to prevent such print defects and to provide systems and methods for modifying the operating characteristics of components used in a remanufactured toner cartridge.

Additionally, the density of the printed output of a laser printer is directly dependent on the bias voltage applied to the developer roller of the toner cartridge. The printer supplies this bias voltage signal to the developer roller and can control this voltage and monitor the printed output. This is done in several steps during the printer calibration process so that the optimum print quality can be maintained.

Such a calibration process has been designed to produce an optimum developer voltage for the particular characteristics of the original toner. When a cartridge is remanufactured often the original toner is not available and a replacement must be used. As described above, the replacement toner will have different characteristics than the original and also likely have a different optimum developer voltage. Thus, there is a need for techniques for modifying the operating characteristics of components, such as a developer roller voltage, for example, used in a remanufactured toner cartridge.

SUMMARY

In one aspect of the present invention, a method of modifying an imaging cartridge comprises providing the imaging cartridge adapted to receive a signal from an imaging device and apply the signal to a component of the imaging cartridge, and attaching a signal modification element to the imaging cartridge to form a modified imaging cartridge, the signal modification element adapted to receive the signal from the imaging device, modify the signal to form a modified signal, and apply the modified signal to the component of the modified imaging cartridge.

In another aspect of the present invention, a method of remanufacturing an imaging cartridge comprises providing the imaging cartridge adapted for receiving a signal from a printer, and attaching an attenuator element to the toner cartridge, said attenuator element adapted for attenuating the amplitude of the signal transmitted from the toner cartridge to the printer.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention. For example, a signal modification element in accordance with the present invention may be used to modify any signal provided to any cartridge component or to modify any signal transmitted from any cartridge component.

Figure 1:
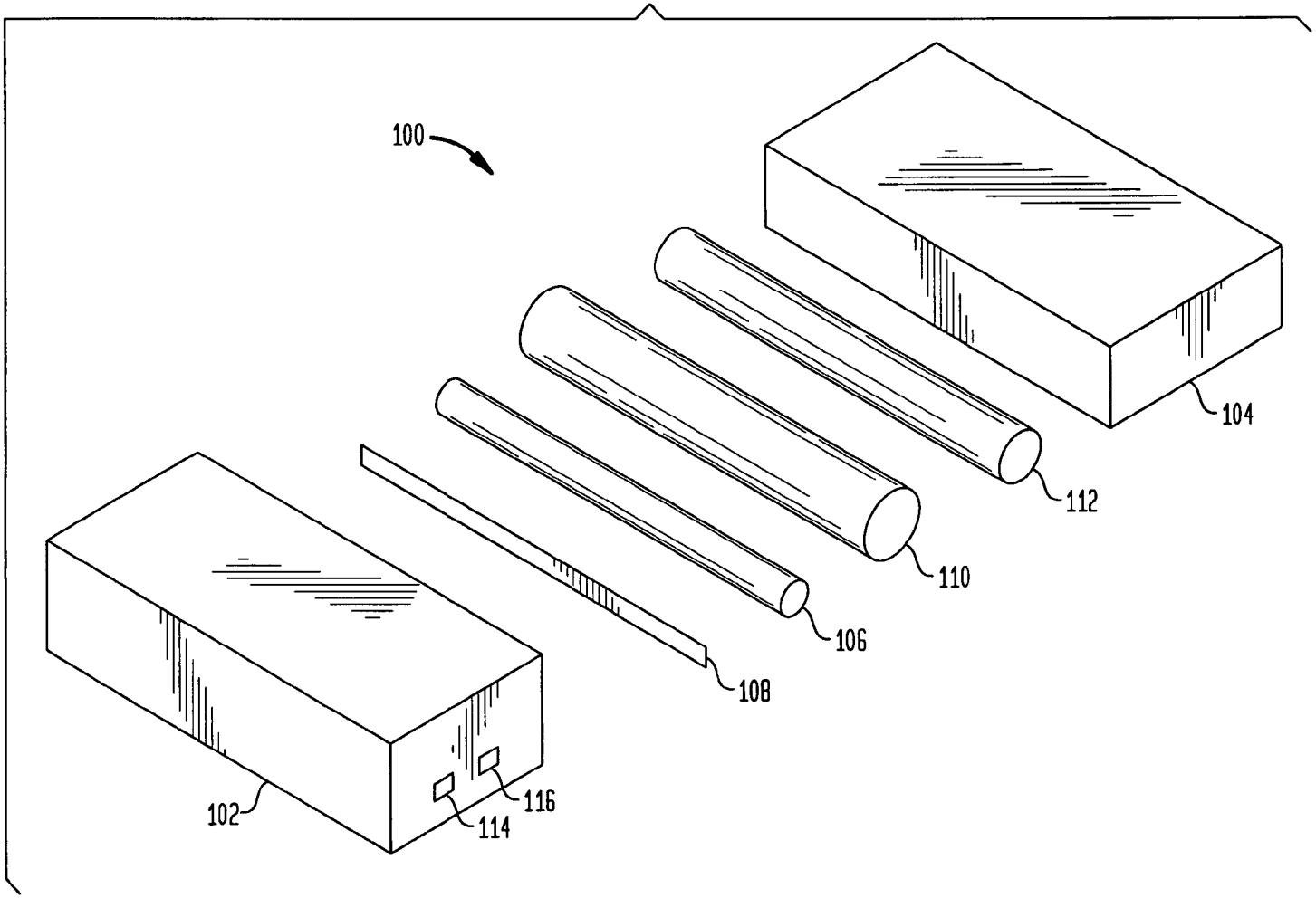
FIG. 1 shows a simplified exploded perspective view of an exemplary toner cartridge.

FIG. 1 shows an exploded view of an exemplary simplified toner cartridge 100. The toner cartridge 100 comprises a variety of components including a toner hopper 102, toner waste bin 104, PCR 106, PCR wiper blade 108, developer roller 110, and an organic photoconductor drum (OPC) 112. The toner cartridge 100 also comprises external contacts 114 and 116. As understood by one of skill in the art, the PCR 106 transfers a charge the OPC drum 112. A latent image is then developed on the OPC drum 112 by laser from the imaging device. Toner is transferred to the OPC drum 112 by the developer roller 110. Both the PCR 106 and the developer roller 110 may have a signal supplied to them from the printer. For example, the PCR 106 may normally have a −1100 VDC supplied to it from the printer through the external contact 114 which is in electrical contact with the PCR 106, and the developer roller 110 may have a voltage of −350 VDC supplied to from the printer through the external contact 116. Note that the voltage levels of these signals are exemplary and may change during the operation of the printer.

As described above, during the remanufacturing process of the toner cartridge 100 the toner cartridge 100 is refilled with toner. Due to the characteristics of particular types of replacement toner or components of the toner cartridge 100, certain problems may develop during printing. These problems may be caused by excess residual toner particles clinging to a component, such as the PCR 106, resulting in the excess toner being transferred to the paper in the form of print defects. The excess residual toner particles may build up on the PCR 106 due to the charge of the toner particles being attracted to the charge of the PCR 106. Normally, these toner particles are cleared away by a PCR wiper blade which cleans the PCR 106 as the PCR 106 rotates, but excess charge on the PCR 106 may cause excess residual toner particles to be retained. This excess charge may be caused by the composition of the toner and/or the PCR 106.

Figure 2:
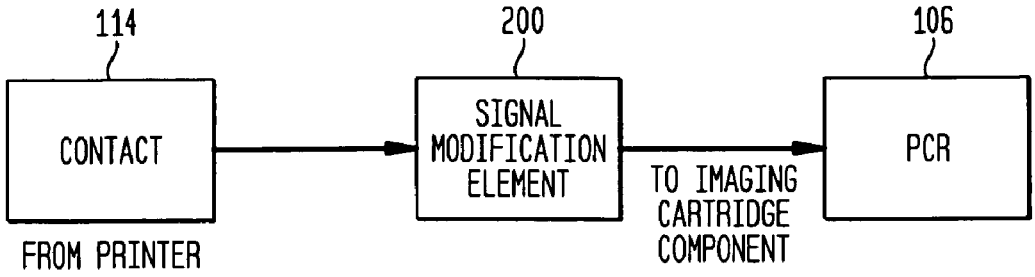
FIG. 2 shows a block diagram of a signal modification element in accordance with the present invention.

In one aspect of the present invention, in order to remove these excess toner particles from the PCR 106, a charge or a signal may be applied to the PCR 106 which reduces the attraction of the excess toner particles to the PCR 106 and thus repels the excess toner particles from the PCR 106. This may allow the PCR wiper blade 108 to scrape away the excess toner particles. FIG. 2 shows a block diagram of a signal modification element 200 in accordance with the present invention. The signal modification element 200 is installed on the toner cartridge 100 to form a modified toner cartridge. As described above, a PCR signal of −1100 VDC, for example, may normally be supplied to the PCR 106. The signal modification element 200 intercepts the PCR signal from the printer and modifies this voltage signal to form a modified PCR signal. The signal modification element then supplies the modified PCR signal to the PCR 106 in order to modify the charge on the PCR 106 and repel the excess toner particles from the PCR 106. The signal modification element 200 may comprise a circuit which may, for example, introduce a changing, or alternating current (AC), component onto the voltage signal to form the modified voltage signal. Such an AC ripple imposed over the DC component of the PCR signal operates to dissipate charge from the PCR 106 and reduce the amount of excess toner particles on the PCR 106. Alternately, the signal modification element 200 may comprise a circuit which may change the amplitude of the PCR signal without providing an AC component.

Figure 3:
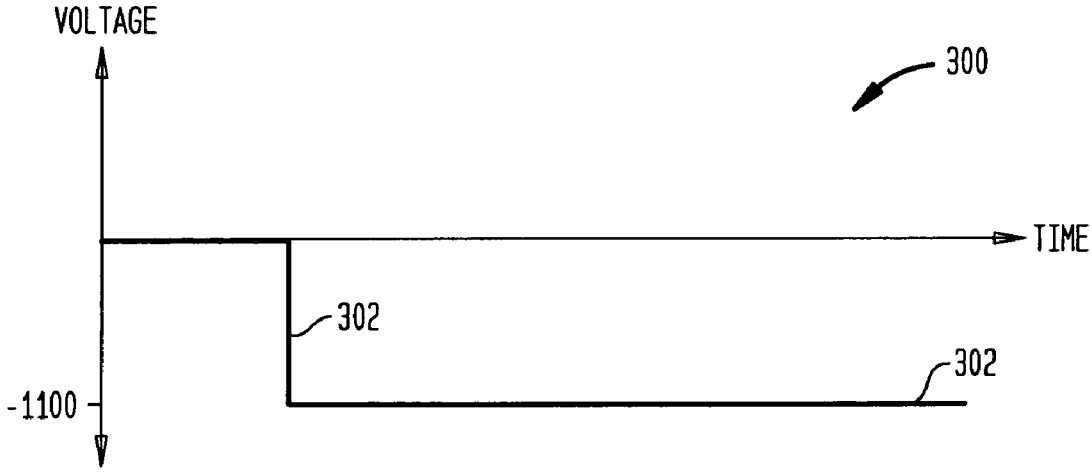
FIG. 3 shows an exemplary unmodified signal to a primary charge roller (PCR)
Figure 4:
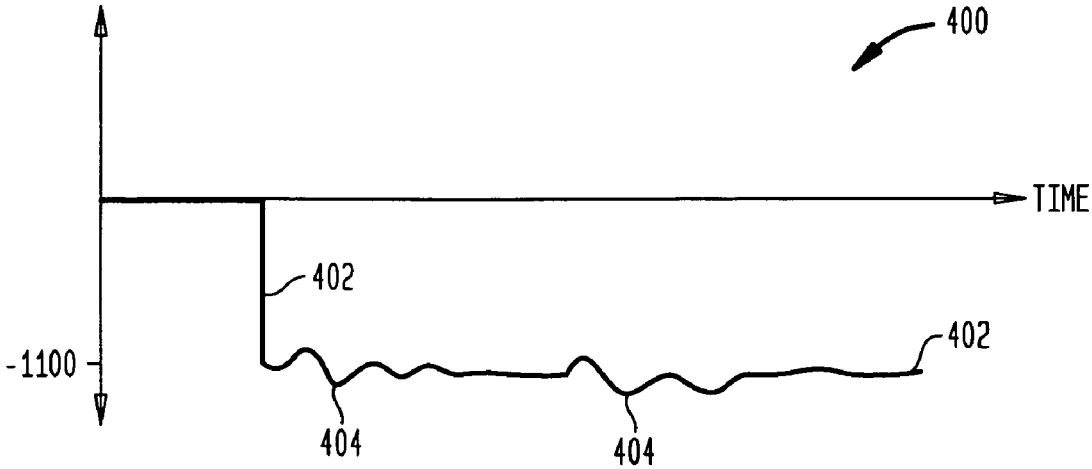
FIG. 4 shows a signal to a PCR modified by a signal modification element in accordance with the present invention.

FIG. 3 shows a graph 300 of an exemplary unmodified PCR signal 302 supplied to the PCR 106 by the printer. FIG. 4 shows a graph 400 of an exemplary modified PCR signal 402 supplied to the PCR 106 as modified by a signal modification element in accordance with the present invention. As seen in FIG. 4, the modified PCR signal 402 includes AC ripples 404.

The modified PCR signal may be applied continuously to the PCR 106. Alternatively, the modified PCR signal may be applied to the PCR 106 only during predetermined time periods, such as, for example, before printing a page, after printing a page, during the cleaning cycle, or any other suitable time. In such a case, when the modified PCR signal is not being applied to the PCR 106, the signal modification element would not modify the PCR signal, but would apply the PCR signal to the PCR 106.

In another aspect of the present invention, as opposed to modifying the voltage applied to the PCR 106 to repel the excess toner, the voltage applied to another component of the toner cartridge 100 may modified to compensate for the excess toner attached to the PCR 106. For example, a signal modification element may be installed on the toner cartridge 100 and intercept a developer roller signal supplied to the developer roller 110 and supply a modified developer roller signal to the developer roller 110 which compensates for the excess toner attached to the PCR 106. For example, the voltage of the developer roller signal supplied from the printer may be increased by a signal modification element which compensates for the excess toner on the PCR 106 by increasing the potential difference between the toner and the developer roller 110, preventing an uncharged area of the OPC drum 112 from being imaged.

For example, on the HP 2600 printer the developer voltage is composed of a negative DC voltage of between −225 and −300 volts with a large 3 KHz AC voltage superimposed on it. The AC component has an amplitude of about 900 Vp-p. Overall print density is dependent on the DC component of the developer voltage. The AC component is there to "shake up" the toner particles and improve print resolution. In the particular case of the HP 2600 printer, the developer voltage needs to be made more negative to compensate for the particular characteristics of the substitute toner. The basic strategy is to add an additional bias DC voltage of the correct polarity in series with the existing developer supply voltage. This should be done with the utmost care so as not to excessively load or disturb the existing developer supply.

A bias generator which supplies the additional bias voltage, described in greater detail below, should be controllable so that it can be turned on and off. This is necessary so that the bias generator can be turned off during the printer's calibration process. If the bias generator were to remain on during the calibration process the printer would just subtract out the additional bias causing the print density to still be incorrect at the end of the process. The bias generator should supply the additional bias voltage during normal printing but must not be there during the calibration process.

Figure 5:
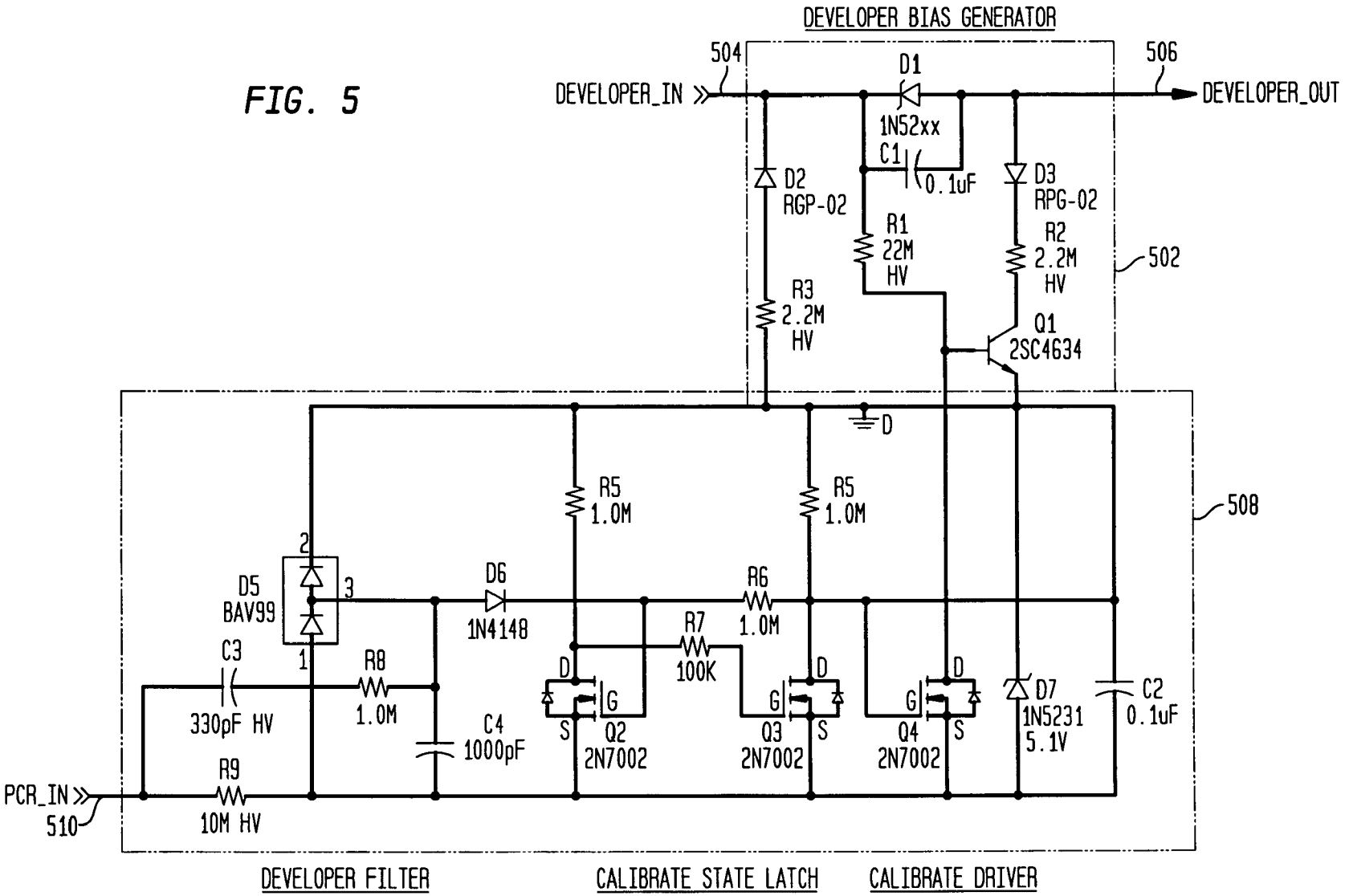
FIG. 5 shows a circuit diagram of a signal modification element in accordance with the present invention.

FIG. 5 shows a circuit diagram of a signal modification element 500 in accordance with the present invention. The signal modification element 500 is installed on the toner cartridge 100 to form a modified toner cartridge. As described above, a developer roller signal may normally be supplied to the developer roller 110. The signal modification element 500 intercepts the developer roller signal from the printer and modifies this voltage signal to form a modified developer roller signal. The signal modification element 500 then supplies the modified developer roller signal to the developer roller 110 in order to compensate for the excess toner on the PCR 106 by increasing the potential difference between the toner and the developer roller 110.

The signal modification element 500 comprises two basic blocks. A first block, a developer bias generator 502, receives the developer roller signal at input 504 and develops the additional DC bias voltage to be applied in series with existing developer voltage signal to form the modified developer roller signal which is output at output 506. A second block, a calibration detector 508, receives the PCR signal at input 510 and detects when the printer is going into the calibration process and then latches the developer bias generator 502 off during the calibration process, thus allowing the developer roller signal to pass unmodified to the developer roller 110 through the output 506.

The developer bias generator 502 comprises diodes D1, D2 and D3, a capacitor C1, resistors R1, R2 and R3, and a transistor Q1. The capacitor C1, diode D3, and R2 form a basic half-wave rectifier that rectifies a little of an AC developer voltage component of the developer roller signal and stores it in capacitor C1. The value of the resistor R2 is preferably chosen to be as large as possible to keep from loading the AC developer too greatly yet small enough to exceed the leakage in the Zener diode D1 and develop the correct zener voltage across it. The capacitor C1 is preferably chosen to be as small as possible to allow fast charging yet large enough to reduce the 3 KHz ripple to an acceptable level. The Zener diode D1 is selected from a family of diodes that each have different voltages. The voltage of the Zener diode D1 is chosen to match the characteristics of a particular toner.

The developer bias generator 502 as described so far will produce the required bias voltage however, it has a serious drawback when connected to the printer. The DC developer supply in the printer is also a half-wave rectified supply with a series diode. The added developer supply effectively pushes against the internal developer supply's diode turning it off and thus disabling it. The solution to this is to use the negative peaks of the AC developer supply to remove excess charge from the rectifier capacitor in the printer's DC developer supply and thus turn the diode back on. This is accomplished with the diode D2 and resistor R3. Note that resistors R2 and R3 are chosen to be identical values to guarantee that the printer's DC developer supply always stays in the circuit. The charge that is added during one half cycle of the AC developer is removed during the next half cycle.

The developer bias generator 502 is controlled by the transistor Q1 and the resistor R1. The transistor Q1 is a high voltage low current switch which opens up the half wave rectifier circuit that generates the additional developer bias voltage. The resistor R1 provides the base drive to turn the transistor Q1 on.

Figure 5A:
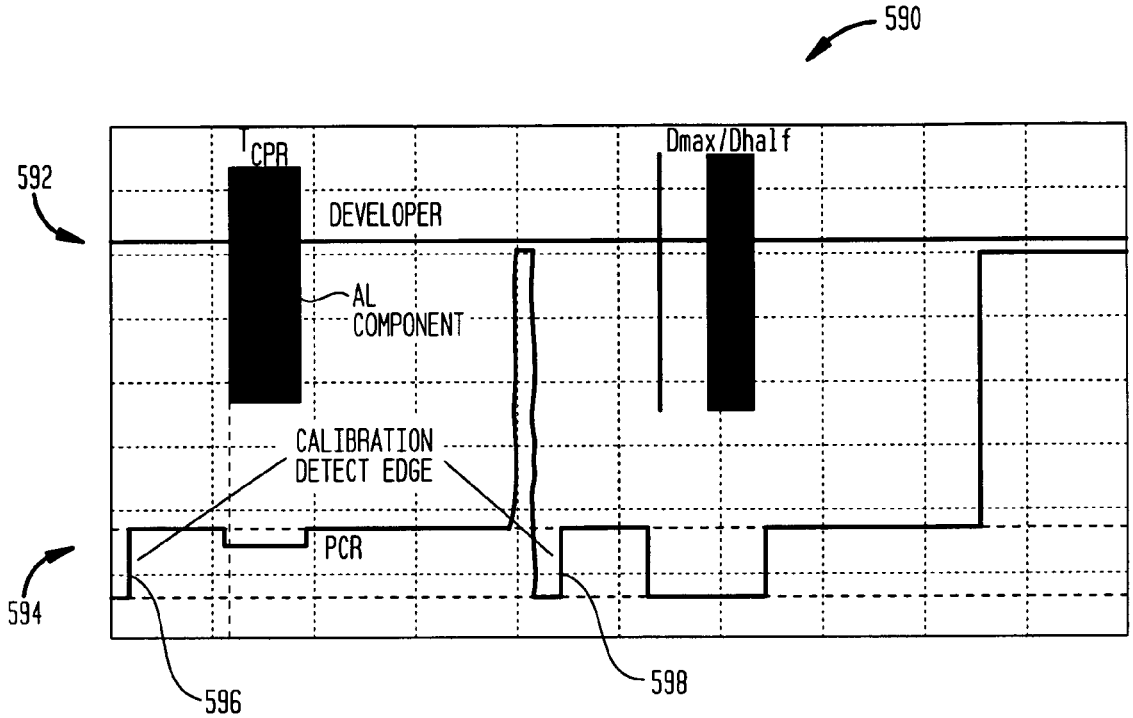
FIG. 5A shows a timing diagram of a developer roller signal and a PCR signal in accordance with the present invention.

The calibration detector 508 works by monitoring the voltage level of the PCR signal from input 510. Under normal printing the voltage level of the PCR signal is constant. When the printer is about to go into a calibration cycle the PCR voltage goes through a transition that is about 220 volts more positive than under normal printing. The calibration detector 508 detects this edge and disables the bias voltage generator 502 when this occurs, allowing the developer roller signal to pass unmodified to the developer roller 110 through the output 506. FIG. 5A shows a timing diagram 590 of a developer roller signal 592 and a PCR signal 594. The calibration detector 508 detects edges 596 and 598 to determine when the printer is entering a calibration cycle.

The calibration detector 508 is also powered by the PCR voltage. Preferrably, the calibration detector 508 operates on mere microamps of current so as not to unduly load the PCR signal which also supplies other toner cartridges in the printer. A resistor R9, Zener diode D7, and capacitor C2 form a 5.1 volt shunt regulated power supply which is used to power the calibration detector 508.

A high voltage capacitor C3 couples the PCR voltage signal to the calibration detector 508. The capacitor C3 is chosen to be as small as possible and still be able to couple the edge of the PCR signal that is being detected. The capacitor C3 feeds a filter which is used to severely attenuate the AC developer component that gets coupled to the PCR supply due to parasitic capacitance in the cartridge. The filter comprises a resistor R8 and a capacitor C4. The values of these components are chosen to get sufficient attenuation of the 3 KHz AC component of the developer signal yet still pass the 220 volt step in the PCR signal. A diode D5 acts as a clamp to prevent the filtered PCR signal from going above or below the calibration detector 508 power supply rails. An auxiliary function of the diode D5 is to source or sink current from the capacitor C3, thus stabilizing the voltage across C3 in preparation for the incoming step in the PCR voltage.

The output of the developer filter feeds a latch which is used to "remember" that the printer is in the calibration process. This memory lasts until the PCR voltage to the circuit is removed, which is once during the calibration process and at the end of every print job. The latch comprises cross coupled transistors Q2 and Q3 and associated components, resistor R4 and resistor R5. In operation only one of the transistors Q2 and Q3 is on at a time which holds the other one off.

Cross coupling resistors R6 and R7 have are selected to have a 10:1 ratio of values to ensure that the voltage on the gate of the transistor Q3 will always rise faster than the voltage on the gate of the transistor Q2, thus guaranteeing that Q3 will be on and Q2 will be off at power up.

A diode D6 couples the output from the developer filter into the latch (transistors Q2 and Q3). The one way action of the diode D6 allows the latch to be set on a positive pulse but prevents it from being reset on a negative one. The output of the latch drives an open drain MOSFET Q4, which controls the bias generator switch, transistor Q1.

Figure 6:
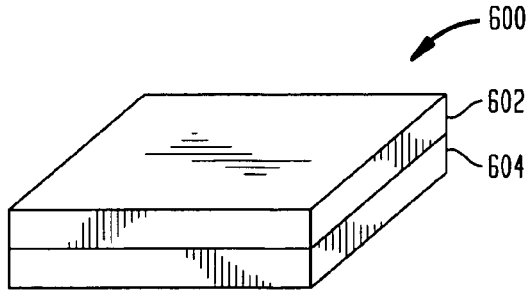
FIG. 6 shows an attenuator element in accordance with the present invention.

Turning to the HP 9000 toner cartridge, the HP 9000 toner cartridge uses a particular technique to sense the toner level when the toner level is below about 8% of capacity. This toner sensing technique appears to utilize an AC signal transmitted from a magnetic roller to a toner sensing plate of the cartridge. A toner level signal is then generated and transmitted to the printer providing information relating to the toner remaining. During the remanufacturing process of the toner cartridge and replacement of the toner hopper seal, the voltage level of the toner level signal may be affected. For example, if the electrical characteristics of the replacement seal do not sufficiently match the electrical characteristics of the original seal, the signal may be transmitted to the printer at a higher voltage level than what is appropriate. The composition of the replacement seal affects the AC signal transmitted from the magnetic roller to the toner sensing plate. In such a situation, the printer may not be able to properly determine the correct toner level due to the higher signal level. In one aspect of the present invention, techniques are provided for attenuating the higher signal level, thus lowering the voltage to an appropriate level for the printer. A signal modification element such as an attenuator element 600 may attached to a contact on the toner cartridge that provides the toner level signal to the printer. As seen in FIG. 6, the attenuator element 600 preferably comprises a conductor 602 and an insulator 604. The conductor 602 may suitably comprise aluminum or copper and the insulator 604 may be an acrylic adhesive. The acrylic adhesive acts as an insulator or spacer to attenuate the toner level signal transmitted to the printer. The insulator 604 may be protected by a release liner prior to installation. The attenuator element 600 may be shaped appropriately to cover the toner cartridge contact. The type of conductor, type of insulator, and their thicknesses and shapes may be varied to reach a desired level of attenuation. For example, the attenuator element 600 may be rectangular and 0.35×0.70 inches.

To install the attenuator element 600, the release liner is removed and the adhesive is used to adhere the attenuator element on the toner cartridge contact. In a preferred embodiment, the attenuator element 600 may be placed on an external contact of the toner cartridge. Alternately, the attenuator element 600 may be placed on an internal contact, or on any other suitable place in the transmission path of the toner level signal in the cartridge. Thus, when the toner cartridge is installed in the printer, the toner level signal will be transmitted to the printer through the attenuator element 600, lowering the voltage signal level of the toner level signal to an appropriate level, such as 2.5 volts peak-to-peak, for example. Other suitable attenuators may also be used which provide the appropriate level of attenuation.

A signal modification element in accordance with the present invention may modify any characteristic of the signal from the printer, such as the voltage level, current level or phase of the signal, to form the appropriate modified voltage signal. The signal modification element may comprise a variety of analog, digital components or passive elements.

A signal modification element in accordance with the present invention may be placed any other suitable place in the transmission path of the signal to be modified.

Although specific embodiments have been illustrated and described herein, those of ordinary skill in the art appreciate that any arrangement that is calculated to achieve the same purpose may be substituted for the specific embodiments shown and that the invention has other applications in other environments. For example, a signal modification element in accordance with the present invention may be used to modify any signal provided to an imaging cartridge, to modify any signal transmitted from an imaging cartridge, or to modify any signal which exists internally to an imaging cartridge. This application is intended to cover any adaptations or variations of the present invention. The following claims are in no way intended to limit the scope of the invention to the specific embodiments described herein.

What is claimed is:

1. A method of modifying an imaging cartridge comprising:

providing the imaging cartridge adapted to receive a signal from an imaging device and apply the signal to a component of the imaging cartridge; and attaching a signal modification element to the imaging cartridge to form a modified imaging cartridge, the signal modification element adapted to receive the signal from the imaging device, modify the signal to form a modified signal, and apply the modified signal to the component of the modified imaging cartridge, wherein the signal modification element does not generate the modified signal during a time period when the imaging device is calibrating, and wherein the signal modification element generates the signal during the time period when the imaging device is not calibrating.

2. A modified imaging cartridge comprising:

a component of the imagine cartridge, the imaging cartridge adapted to receive a signal from an imaging device and apply the signal to the component of the imaging cartridge; and a signal modification element attached to the imaging cartridge to form a modified imaging cartridge, the signal modification element adapted to receive the signal from the imaging device, modify the signal to form a modified signal, and apply the modified signal to the component of the modified imaging cartridge, wherein the signal modification element does not generate the modified signal during a time period when the imaging device is calibrating, and wherein the signal modification element generates the signal during the time period when the imaging device is not calibrating.

* * * * *